US005960974A

United States Patent [19]

Kee et al.

[11] Patent Number: 5,960,974

[45] Date of Patent: Oct. 5, 1999

[54] INTERMODAL BULK CONTAINER

[75] Inventors: Douglas P. Kee, Emerald Park; Douglas M. Russell; Raymond L. Hicton, both of Regina, all of Canada

[73] Assignee: Advance Engineered Products Ltd., Canada

[21] Appl. No.: 08/725,412

[22] Filed: Oct. 3, 1996

[51] Int. Cl.[6] ..... B65D 88/00

[52] U.S. Cl. ..... 220/1.5; 222/185.1

[58] Field of Search ..... 220/1.5; 222/185.1; 406/119

[56] References Cited

U.S. PATENT DOCUMENTS

| | | |
|---|---|---|
| 2,056,179 | 10/1936 | Fitch . |
| 3,269,779 | 8/1966 | Rollins . |
| 3,726,431 | 4/1973 | Botkin . |
| 3,912,103 | 10/1975 | Gerhard . |
| 3,971,491 | 7/1976 | Mowatt-Larssen et al. . |
| 4,307,812 | 12/1981 | Gerhard . |
| 4,345,861 | 8/1982 | Aarseth . |
| 4,381,062 | 4/1983 | Taquoi . |
| 4,412,626 | 11/1983 | Gerhard . |
| 4,416,384 | 11/1983 | Bjurling . |
| 4,441,678 | 4/1984 | Dorpmund . |
| 4,574,986 | 3/1986 | Baris et al. . |
| 4,593,832 | 6/1986 | Gerhard . |
| 4,603,788 | 8/1986 | Gerhard . |
| 4,823,989 | 4/1989 | Nilsson . |
| 4,840,282 | 6/1989 | Gerhard . |
| 4,902,173 | 2/1990 | Hendee et al. . |
| 4,917,544 | 4/1990 | Crahan et al. . |
| 5,083,673 | 1/1992 | Fossey . |
| 5,178,292 | 1/1993 | Korzeniowski . |
| 5,248,227 | 9/1993 | Hidock et al. . |
| 5,353,967 | 10/1994 | Toth et al. . |
| 5,390,806 | 2/1995 | Elston et al. . |
| 5,390,827 | 2/1995 | Toth et al. . |
| 5,529,222 | 6/1996 | Toth et al. . |

FOREIGN PATENT DOCUMENTS

| | | |
|---|---|---|
| 0 621 212 A1 | 10/1994 | European Pat. Off. . |
| 2 098 965 | 5/1982 | United Kingdom . |

OTHER PUBLICATIONS

Northbrook Container Leasing—two sheet brochure entitled"Tank Container General Specifications", Aug. 1996.

Stolt Intermodal Services—one sheet brochure entitled "In it for the Long Haul", Aug. 1996.

Alaska Marine Lines—set of four drawings number D.B.P.D.C. 1,2,3 and D.B.P.D.C. Pictorial. Jun. 1987.

Welfit Oddy Tank Containers—one sheet brochure entitled "Tank Containers", Aug. 1996.

Westank–Willock Drawing No. 01038601 REV A, dated Sep. 1990.

Westank–Willock Drawing No. 03182101, dated Aug. 1991.

Advance Engineered Products Drawing No. CSF00157 REV 4, dated Feb. 1985.

Advance Engineered Products Drawing No. DAT03426 REV 1, dated Aug. 1996.

(List continued on next page.)

*Primary Examiner*—Steven Pollard

*Attorney, Agent, or Firm*—Brinks Hofer Gilson & Lione

[57] ABSTRACT

An intermodal bulk container includes a rigid outer frame having end frames interconnected by two upper trusses and two lower trusses. The lower trusses each form a respective sill. A container vessel is mounted within the outer frame and includes a cylindrical shell that forms lower openings. Hoppers are mounted in the shell to extend out of the lower openings, and these hoppers are joined to an interior surface of the shell above the openings. First and second domed end portions are secured to the shell to close respective ends of the shell. Lower support plates are secured to an exterior surface of the shell, and these lower support plates are secured to the sills to secure the vessel within the frame. The outer frame is fabricated as upper and lower frame portions that are completed prior to assembly with the vessel. The upper and lower frame portions are then separated and the vessel is installed in the lower frame portion. Then the upper frame portion is assembled over the vessel and welded to the lower frame portion.

15 Claims, 9 Drawing Sheets

OTHER PUBLICATIONS

Advance Engineered Products Drawing No. DAT03486, dated Sep. 1996.

Westank Industries Drawing No. R–6412–L REV B, dated Sep. 1973.

Advance Engineered Products—11 page brochure entitled "Identification of Aeration System Components", Aug. 1996.

Advance Engineered Products one page brochure entitled "Advance: the rising star of Canadian trucking", dated Aug. 1996.

INTERMODAL BULK CONTAINER

BACKGROUND OF THE INVENTION

This invention relates to an intermodal bulk container for transporting dry bulk materials such as flour, starch, plastic pellets, and other edible or chemical products.

Intermodal bulk containers are in widespread use today. Toth U.S. Pat. No. 5,529,222 describes one such container which includes a noncylindrical vessel that is welded in place within a rectangular frame. Skirt rings at the ends of the vessel and side panels secured to the hoppers tie the vessel to the ends of the frame.

Dorpmund U.S. Pat. No. 4,441,678 discloses a cylindrical tank mounted within a rectangular frame. The tank includes support rings which rest on side frames of the external frame.

Some prior intermodal containers have utilized aluminum frames, which can be relatively difficult to repair once damaged. Other intermodal containers have utilized a container vessel which forms an integral part of the outer frame. This approach can further increase the cost of repair.

A need presently exists for an improved intermodal container that is durable, but if necessary can be readily repaired in the field, that is light in weight, and that uses a lightweight, aluminum sheet construction for the container vessel.

DETAILED DESCRIPTION OF THE PRESENTLY PREFERRED EMBODIMENTS

The preferred embodiment described below provides the advantages of a relatively light-weight aluminum vessel mounted within a rigid, high strength steel frame that substantially isolates the vessel from lifting and restraining forces on the frame. This combination reduces the cost and weight of the vessel and provides an outer frame that can readily be repaired in the field. Since the vessel is separate from and removably connected to the outer frame, damage to the outer frame often can be repaired without modification or repair to the vessel itself. In the event of extensive damage to the frame, the vessel can be removed from the damaged frame and mounted in a replacement frame.

The preferred method described below for assembling the container simplifies fabrication, in that it allows the outer frame to be fabricated separately from the container vessel, before the container vessel has been installed in the outer frame.

Figure 3:
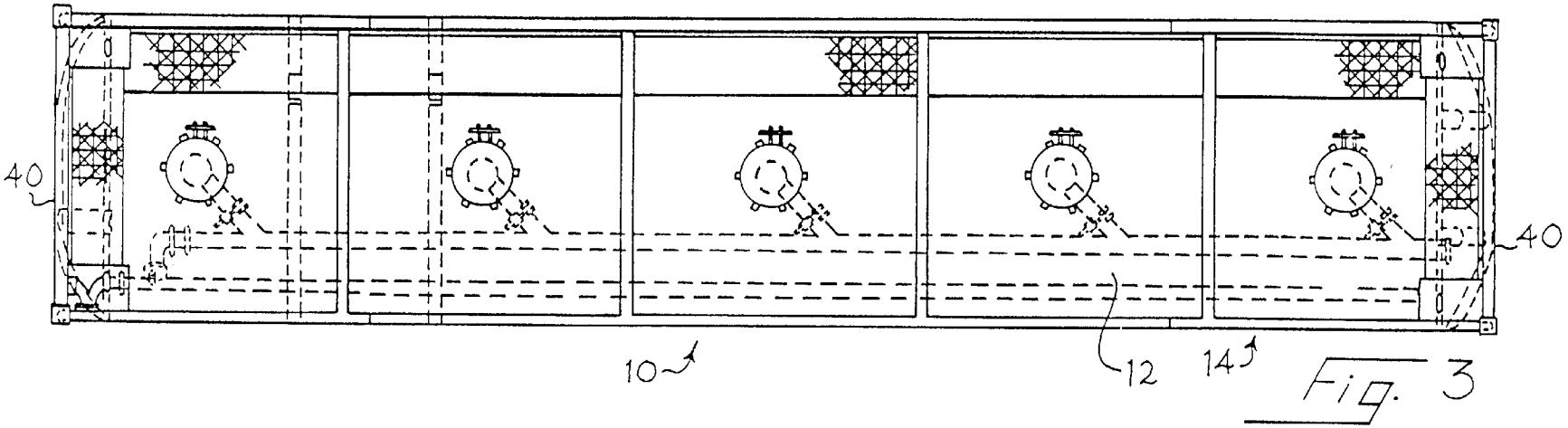
FIG. 3 is a top view taken along line 3—3 of FIG. 1.
Figure 1:
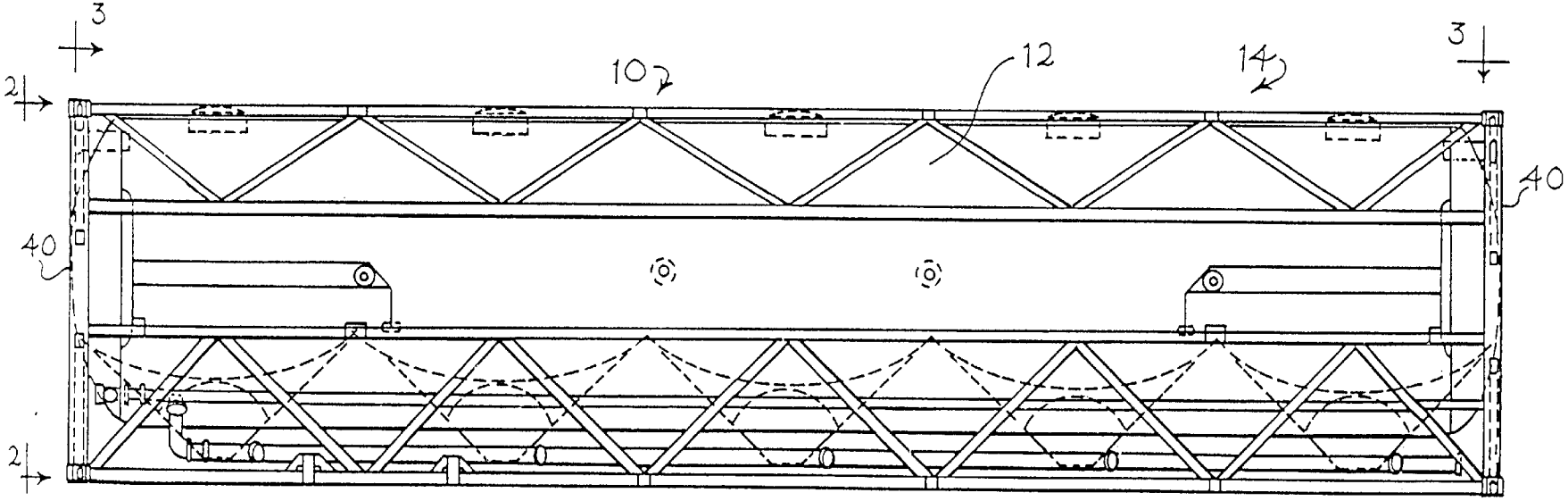
FIG. 1 is a side elevational view of an intermodal container that incorporates a presently preferred embodiment of the present invention.

Turning now to the drawings, FIG. 1 shows a side elevational view of an intermodal container 10 that includes a container vessel 12 mounted within and protected by an outer frame 14. The following discussion will first describe the structure of the vessel 12 and the frame 14 separately, before describing how the vessel is secured within the frame.

Figure 5:
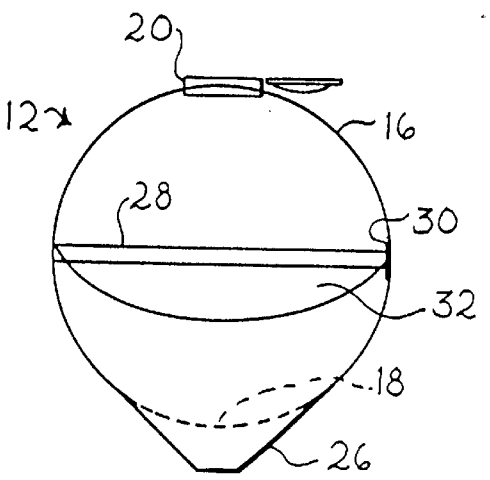
FIG. 5 is a cross-sectional view taken along line 5—5 of FIG. 4.
Figure 6:
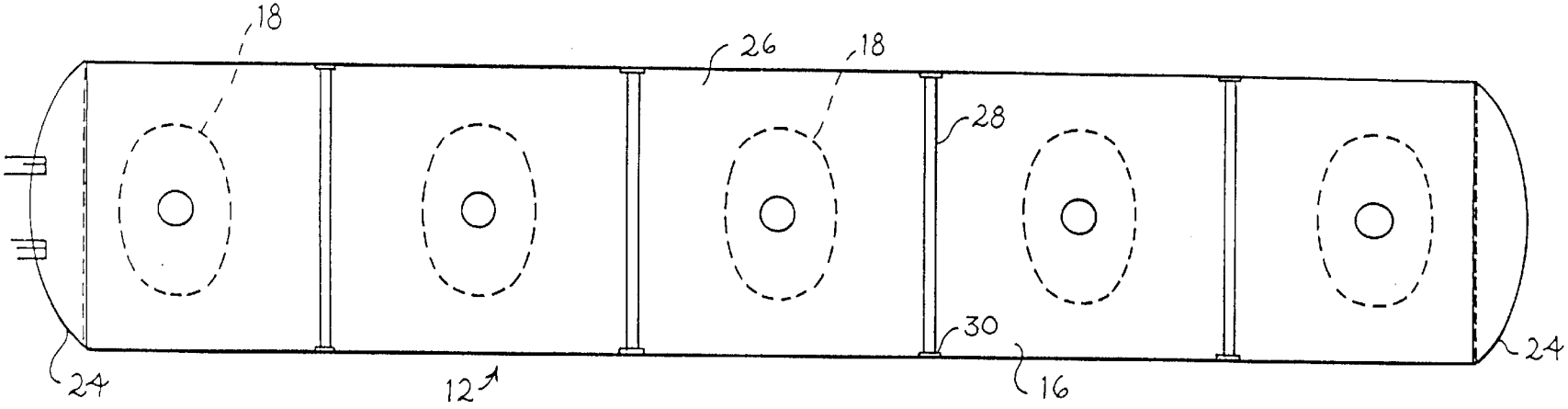
FIG. 6 is a cross-sectional view taken along line 6—6 of FIG. 4.
Figure 4:
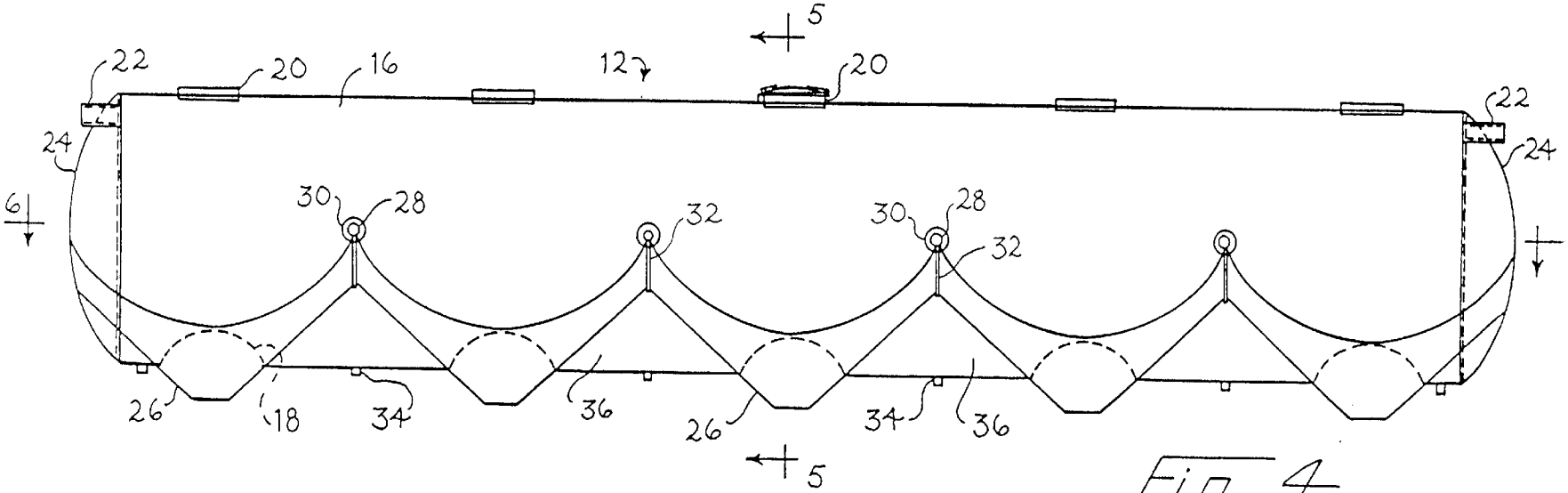
FIG. 4 is a side elevational view of the container vessel of the embodiment FIG. 1.

As shown in FIGS. 4, 5 and 6, the vessel 12 includes a cylindrical shell 16 which defines openings 18 longitudinally spaced along the lowermost portion of the shell 16. Manways 20 are mounted in the shell 16 vertically aligned with the respective openings 18. The circular ends of the cylindrical shell 16 are closed by domed end portions 24, and fill lines 22 pass through the upper portion of each of the end portions 24. Conical hoppers 26 are welded in place in the cylindrical shell 16. A lower portion of each of the hoppers 26 extends through the respective opening 18, and the upper edges of the hoppers 26 are welded to an interior surface of the cylindrical shell 16.

Figure 12:
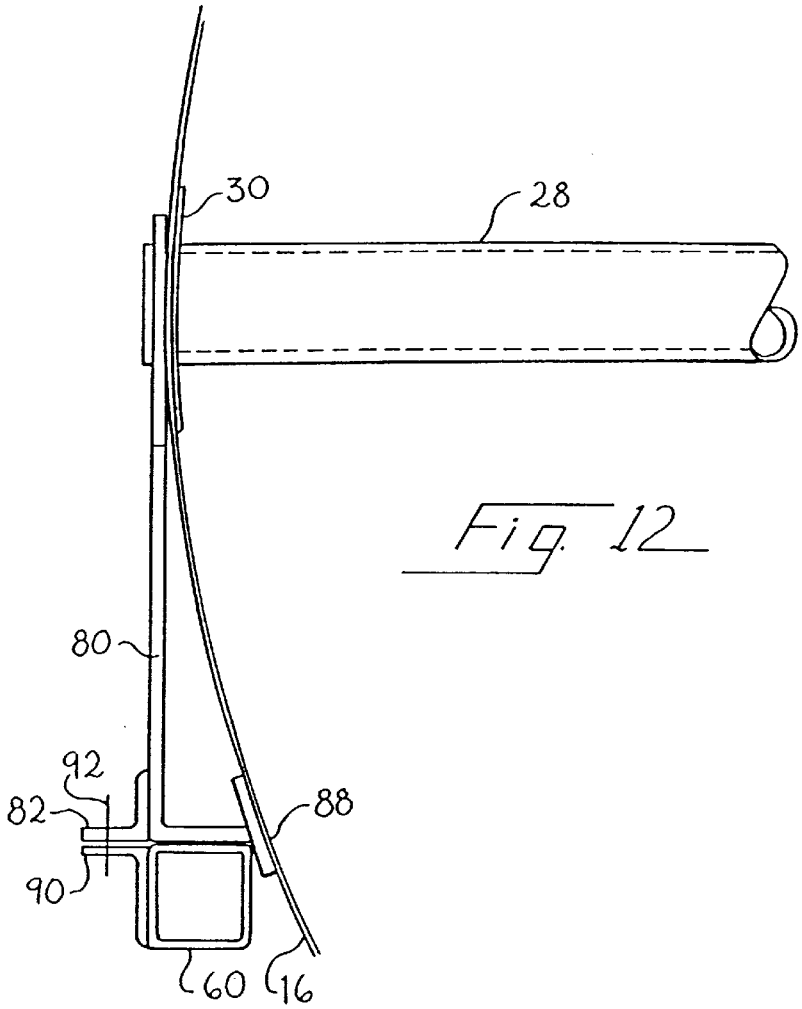
FIG. 12 is a partial sectional view taken along line 12—12 of FIG. 10.

Cross braces 28 are mounted between the hoppers to extend along a diameter of the cylindrical shell 16, thereby bracing the shell 16 against distortion. Each of the cross braces 28 is welded in place to the shell 16, and each junction between the cross brace 28 and the shell 16 is braced by a pad 30. Two of the cross braces 28 (one at each end of the shell 16 ) pass through the shell 16 as shown in FIG. 12. A vertical partition wall 32 is welded at its upper end to each cross brace 28 and at its lower end to the two adjacent hoppers 26. The region in the shell 16 between and beneath the hoppers 26 forms dead space 36 that is drained by drain nipple 34.

Figure 8:
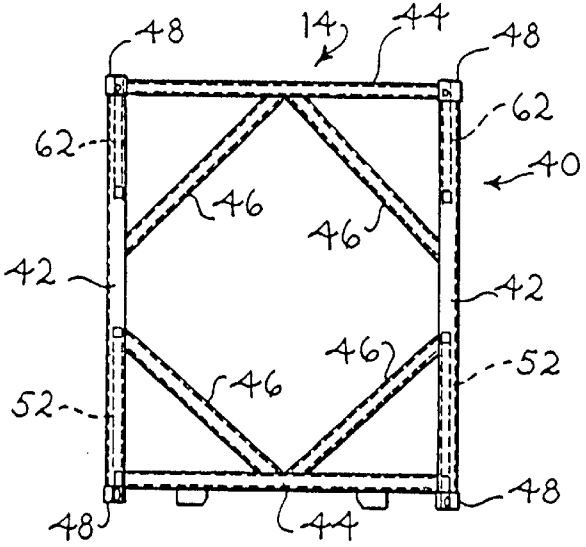
FIG. 8 is an end view taken along line 8—8 of FIG. 7.
Figure 2:
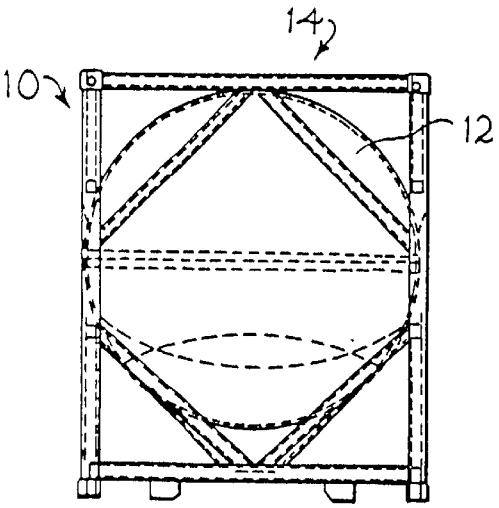
FIG. 2 is an end view taken along line 2—2 of FIG. 1.
Figure 9:
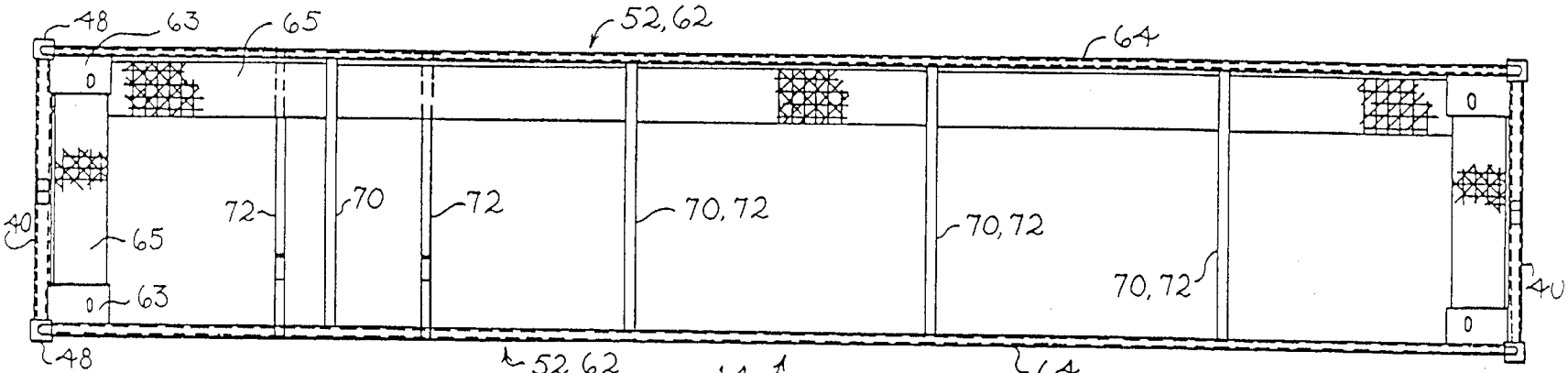
FIG. 9 is a top view taken along line 9—9 of FIG. 7.
Figure 7:
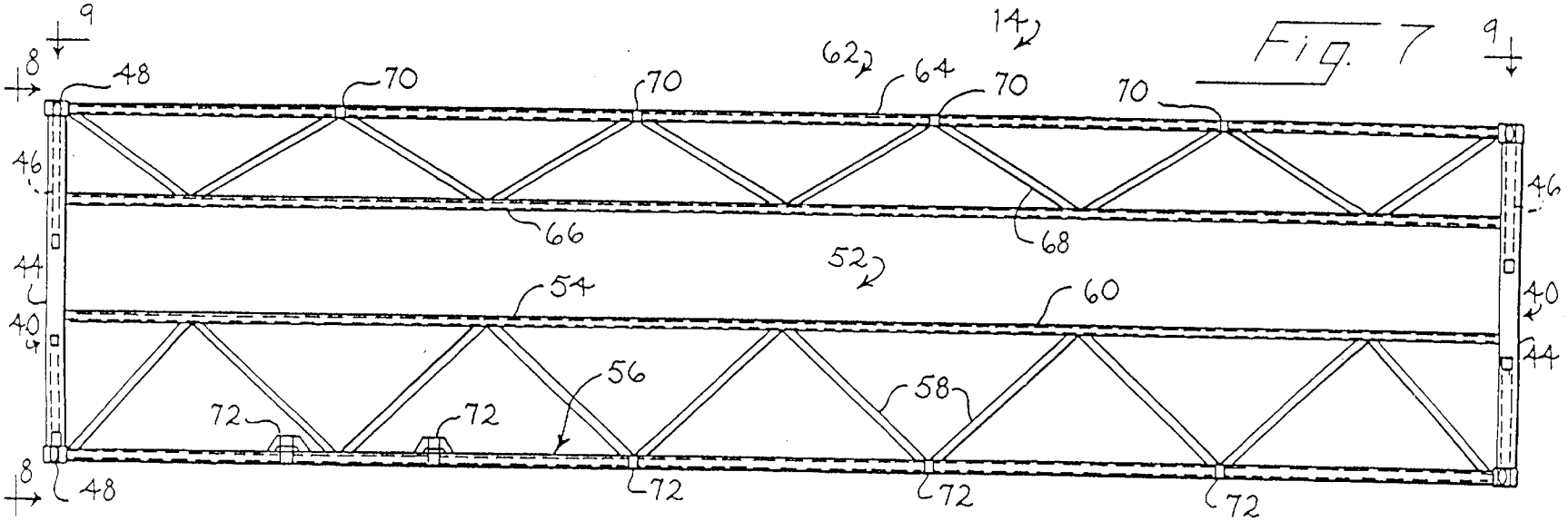
FIG. 7 is a side elevational view of the outer frame of the embodiment of FIG. 1.

As best shown in FIG. 7–9, the outer frame 14 includes two spaced, parallel end frames 40. As best shown in FIG. 8, each end frame 40 includes two parallel columns 42 that are connected by upper and lower beams 44. Diagonally extending braces 46 brace each of the corners of the end frame 40. Each corner of the end frame 40 supports a conventional, industry standard corner casting 48 that is shaped in a conventional way to assist in lifting, stacking and securing the outer frame 14 in place. A ladder can be formed in one or both of the end frames 40. The entire end frame 40 is welded together of hollow structural steel to form a rigid structure.

As best shown in FIGS. 7 and 8, the two end frames 40 are rigidly interconnected by two lower trusses 52, one on either side of the end frames 40. Each lower truss 52 includes a respective upper chord 54 and lower chord 56. The chords 54, 56 are inter-connected by diagonally extending cross braces 58, and the upper chord 54 forms a sill 60.

Similarly, the two end frames 40 are rigidly interconnected by a pair of upper trusses 62, one on either side of the end frames 40. Each upper truss 62 includes a respective upper chord 64 and lower chord 66. The chords 64, 66 are interconnected by diagonal cross braces 68. The lower and upper trusses 52, 62 are rigid structural frames which rigidly interconnect the end frames 40 to form a stiff, rigid outer frame As best shown in FIGS. 7 and 9, upper cross tubes 70 are welded between the upper chords 64, and lower cross tubes 72 are welded between the lower chords 56.

Steel corner plates 63 are provided at the upper corners of the frame 14, and they provide corner supports to walkways 65.

Figure 10:
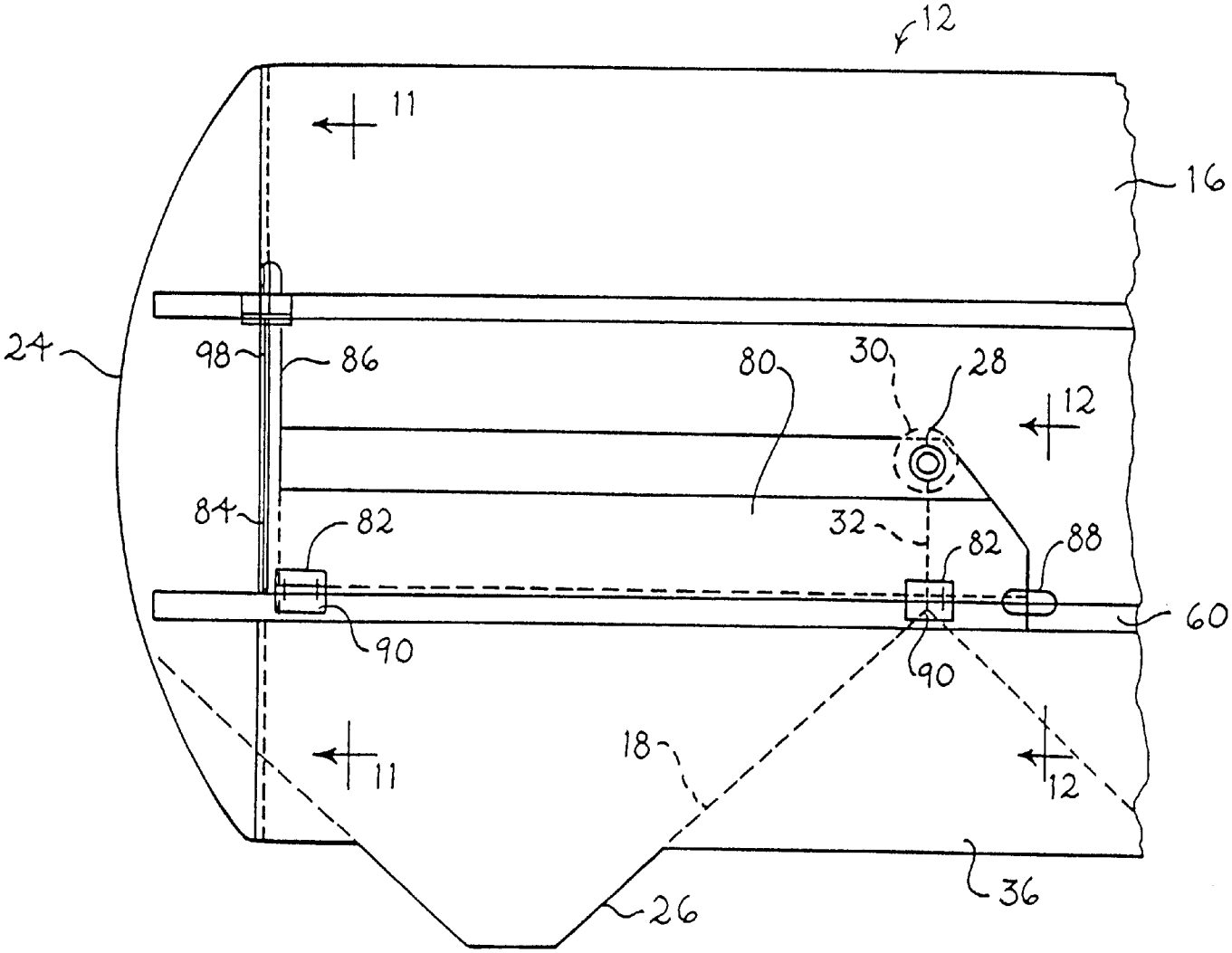
FIG. 10 is a detailed view of selected portions of the intermodal container of FIG. 1, showing the manner in which the vessel is joined to the outer frame.
Figure 11:
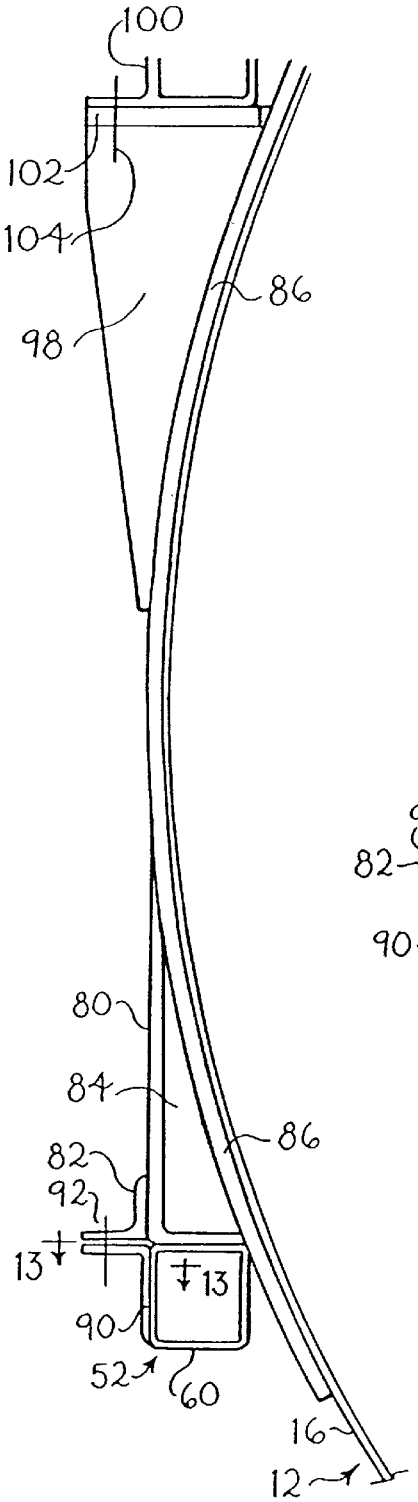
FIG. 11 is a partial sectional view taken along line 11—11 of FIG. 10.

The vessel 12 includes four lower support plates 80. FIG. 10 shows one of these lower support plates 80, and the other three are substantially identical. Each lower support plate 80 is rigidly welded in place to the cylindrical shell 16, and supports a pair of plate angles 82. As best shown in FIG. 11, a lower end plate 84 is welded to brace the junction between the lower support plate 80 and the cylindrical shell 16 in the region of an exterior pad 86. The exterior pad 86 is welded to an exterior surface of the cylindrical shell 16 to spread loads on the cylindrical shell 16 imposed by the lower end plate 84. The cylindrical shell 16 also supports a second pad 88 near the opposite end of the lower support plate 80.

The plate 80 is welded to the vessel 12 along the top and bottom edges of the plate 80, which is notched at one end to receive the pad 88. If desired, a second end plate (not shown) can be welded between the plate 80 and the vessel 12 adjacent the pad 88.

The plate 80 is preferably formed as an angle, as shown in FIG. 12. As used herein, the term "plate" is intended broadly to cover a wide range of structural elements, both formed and unformed, whether or not they are fabricated from multiple parts, and whether or not they mount additional elements.

Figure 13:
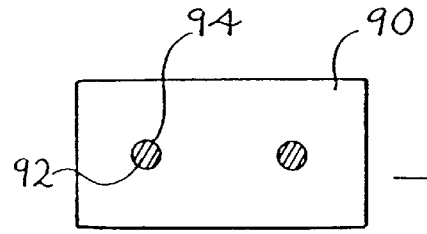
FIG. 13 is a partial sectional view taken along line 13—13 of FIG. 11.
Figure 14:
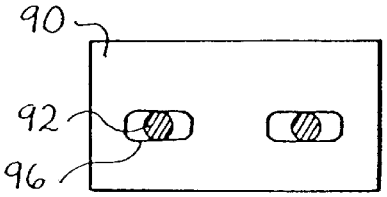
FIG. 14 is a view corresponding to FIG. 13 of another lower sill angle.

The upper chord 54 supports a pair of lower sill angles 90, each aligned with a respective one of the plate angles 82. Threaded fasteners 92 such as bolts interconnect the respective plate angles 82 and lower sill angles 90 to secure the vessel 12 in the outer frame 14. As best shown in FIG. 13, the four lower sill angles 90 positioned at one end of the vessel 12 define circular openings 94 that receive the threaded fasteners 92, thereby fixing the respective end of the vessel 12 in the outer frame 14. The four lower sill angles 90 at the opposite end of the vessel 12 define elongated openings 96 that receive the threaded fasteners 92. These elongated openings 96 allow sliding motion of preferably at least about plus or minus one quarter of an inch between the respective plate angles 82 and lower sill angles 90. This sliding motion accommodates differential thermal expansion between the aluminum vessel 12 and the steel outer frame 14. Bearing plates formed of a material such as Teflon may be interposed between the angles 82, 90 to facilitate this sliding motion. Stop plates (not shown) may be secured to the sills to limit longitudinal movement of the vessel in the frame.

Additionally, as shown in FIG. 11, the vessel 12 supports four upper end plates 98, each welded to a respective one of the pads 86. The upper end plates 98 terminate at upper plate angles 102, which are bolted to respective upper sill angles 100 by threaded fasteners 104. Note that the lower support plates 80 extend parallel to the lower trusses 52 while the upper end plates 98 operate as upper support plates extending parallel to the end frames 40. The upper end plates 98 support the upper portion of the vessel 12 against lateral forces, parallel to the end frames 40 and transverse to the plane of the trusses 52, 62.

The vessel 12 is not secured to the end frames 40, and all connections between the vessel 12 and the outer frame 14 are spaced from the end frames 40 by at least eight inches.

From this description it should be apparent that the lower support plates 80 support the vessel 12 on the sills 60 with the vessel 12 fixed at one end and slideably mounted at the other end to the sill 60. Because the vessel 12 is only fixed to the sills 60 at one end, the vessel 12 is substantially isolated from longitudinal forces applied to the outer frame 12 in lashing, restraining and moving the container 10. Because the vessel 12 is isolated from such forces, a relatively thin aluminum sheet can be used to form the vessel 12.

Figure 15:
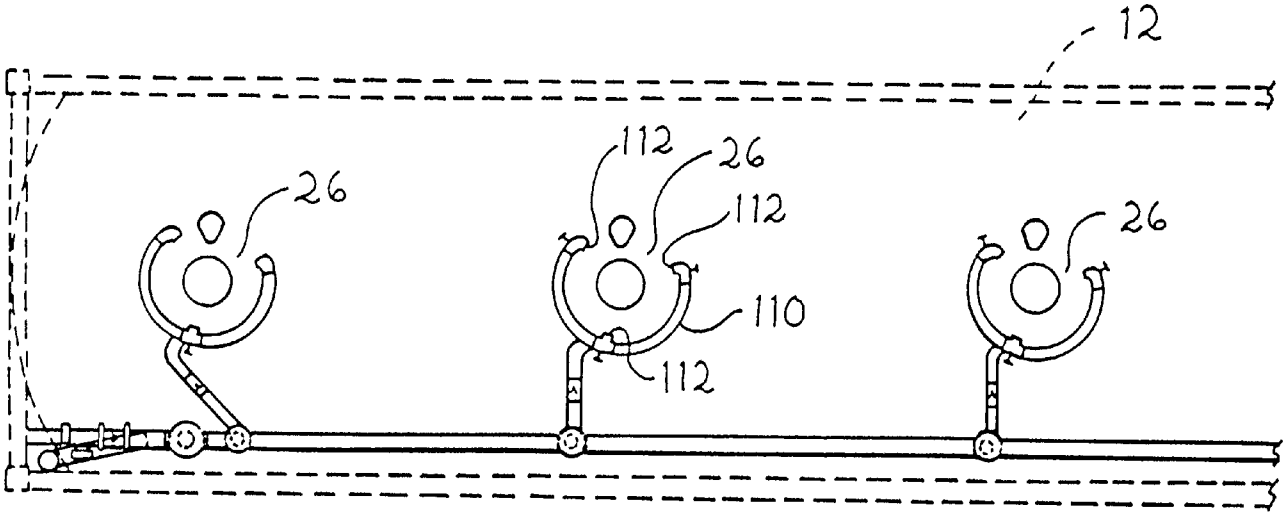
FIG. 15 is a schematic plan view of air inlet lines included in the embodiment of FIG. 1.
Figure 16:
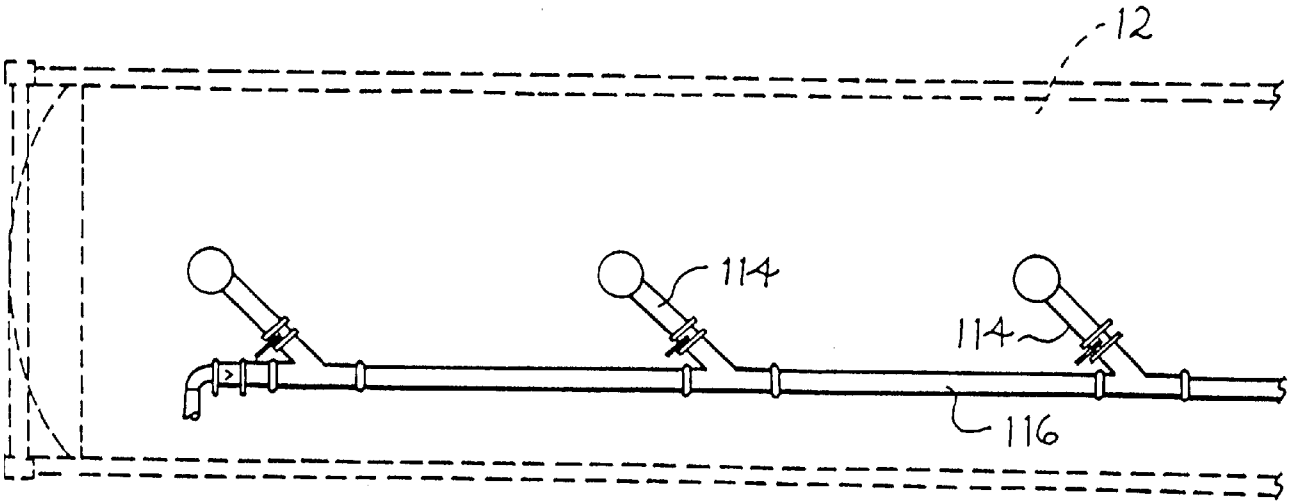
FIG. 16 is a schematic plan view of product outlet lines included in the embodiment of FIG. 1.

FIGS. 15 and 16 provide schematic views of piping used to facilitate unloading of the vessel 12. As shown in FIG. 15, each of the hoppers 26 is surrounded by a respective air inlet line 110, which discharges pressurized air into the interior of the respective hopper 26 via air discharge openings 112. Discharged air fluidizes dry bulk material within the vessel 12 to facilitate flow of this material out of the hoppers 26 via product outlet lines 114 as shown in FIG. 16. These product outlet lines 114 feed into an air conveyor discharge line 116.

Figure 18:
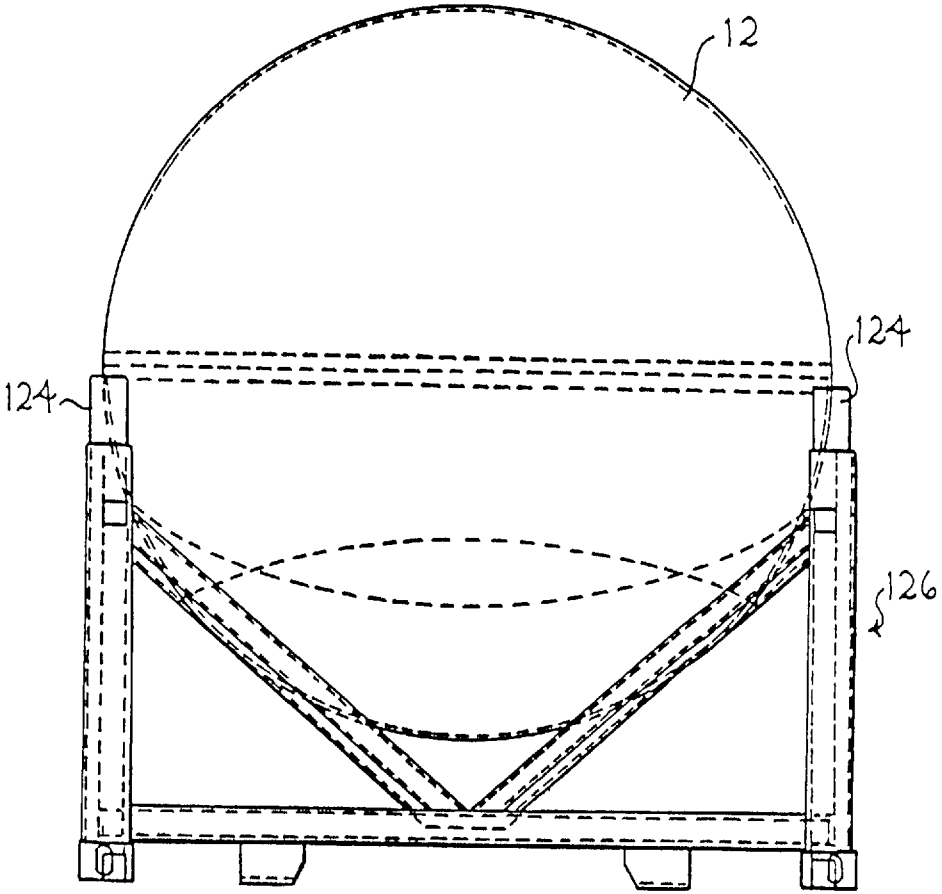
FIG. 18 is an end elevational view showing the container vessel of FIGS. 4–6 mounted in place on the lower frame portion of FIG. 17.
Figure 17:
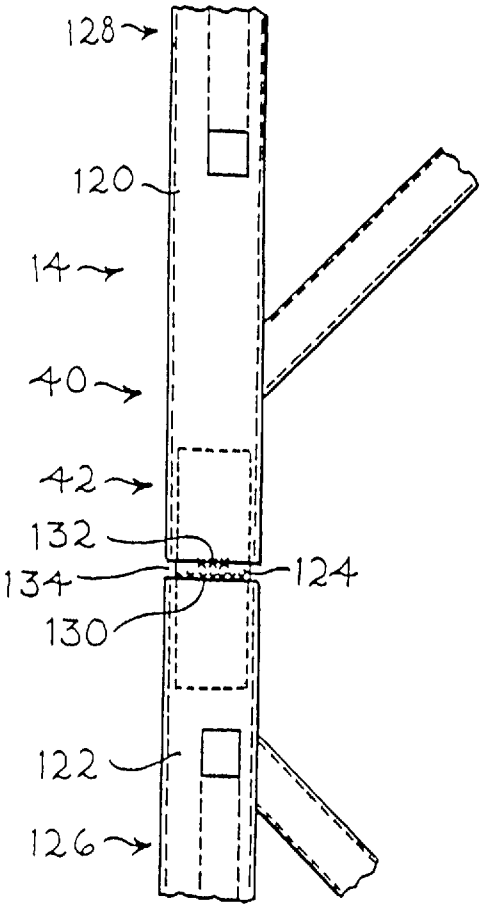
FIG. 17 is a fragmentary end elevational view showing parts of upper and lower frame portions.
Figure 19:
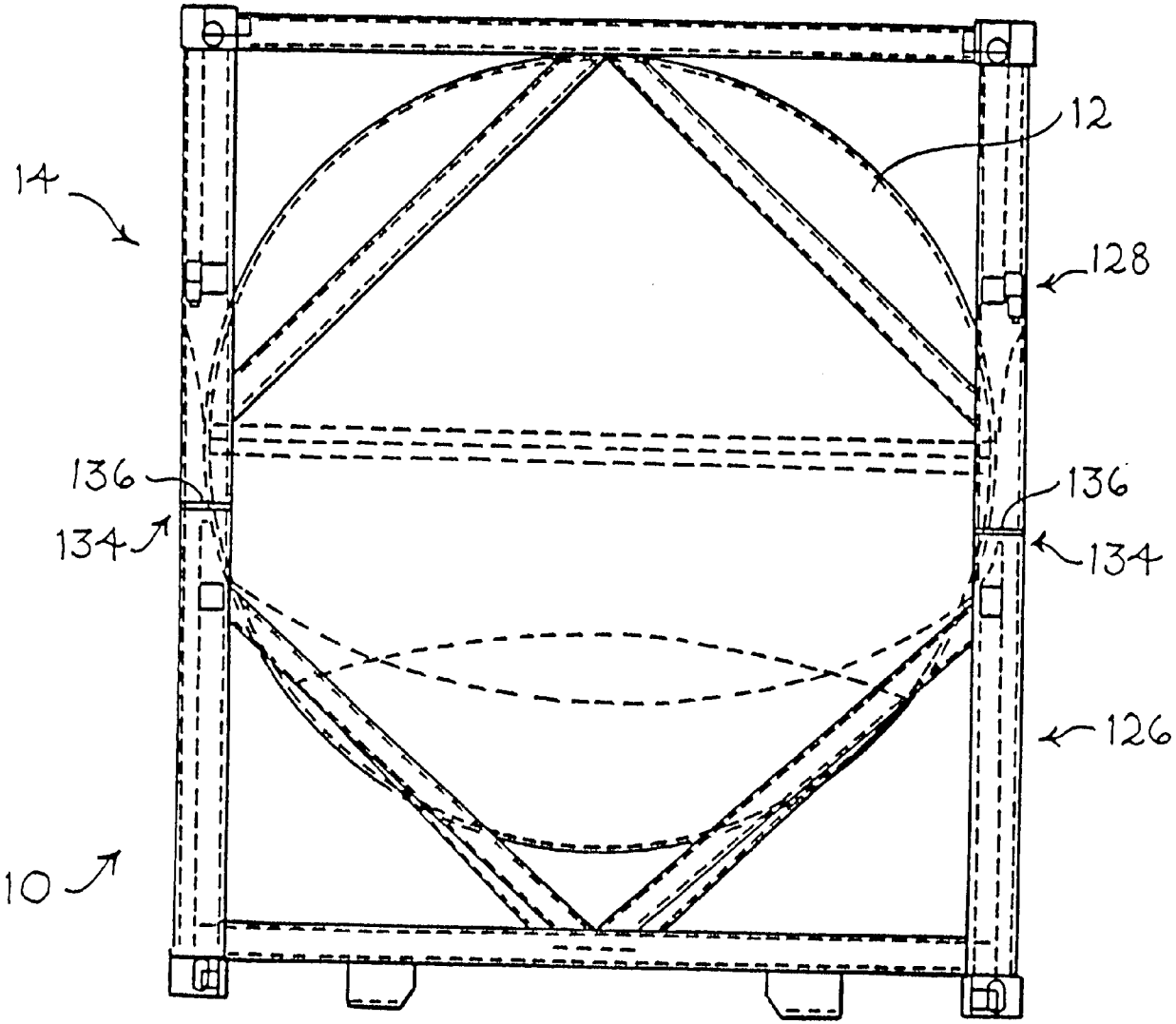
FIG. 19 is an end elevational view showing the upper frame portion of FIG. 17 mounted to the lower frame portion of FIG. 18 to surround the vessel.

FIGS. 17–19 show various stages in the fabrication of the container 10 described above. This fabrication method simplifies construction and eliminates all interference between the vessel 12 and the outer frame 14 during fabrication of the outer frame 14.

As shown in FIG. 17, each of the vertical columns 42 of the end frames 40 of the outer frame 14 is preferably formed of an upper column 120 and a lower column 122 interconnected by a rectangular tube 124. Initially, during fabrication of the end frame 40 and the outer frame 14, the tube 124 is permanently welded in place to the lower column 122 by permanent weld 130. The tube 124 is temporarily welded in place to the upper column 120 by a series of temporary welds 132 positioned to form a precisely dimensioned gap 134 between the upper and lower columns 120, 122. For example, the temporary welds 132 can be one inch long welds on each of the four faces of the tube 124.

During fabrication of the end frames 40 and the outer frame 14, the upper and lower columns 120, 122 and the tube 124 ensure that each column 42 is rigid, and fabrication of the outer frame 14 proceeds in the normal manner. Note that the entire outer frame 14 can be completely fabricated, before the vessel 12 has been assembled with the outer frame 14.

Once the outer frame 14 has been completely fabricated and painted, the temporary welds 132 are removed (as for example by grinding) and the outer frame 14 is separated into a lower frame portion 126 and an upper frame portion 128. This is done by simply moving the upper frame portion 128 vertically out of engagement with the tubes 124.

Once the upper frame portion 128 has been removed from the lower frame portion 126, the separately fabricated vessel 12 (including all piping) can then be installed on and secured to the lower frame portion 126, as shown in FIG. 18. Once the vessel 12 has been secured to the lower frame portion 126, the upper frame portion 128 is then installed over the vessel 12, with the upper columns 120 fitting over the tubes 124. Fixtures (not shown) are provided to dimension the gap 134 precisely. The gap is then filled with a full penetration weld 136 interconnecting the upper and lower columns 120, 122 (FIG. 19). The tube 124 serves as a backing surface to ensure that the full penetration weld 136 is adequate in strength. This completes fabrication of the container 10.

The fabrication method described above in conjunction with FIGS. 17–19 provides a number of important advantages. The outer frame 14 and the vessel 12 can be separately fabricated and finished. This eliminates difficulties associated with spatial interference between vessel 12 and the outer frame 14 when the outer frame 14 is fabricated piece by piece around the vessel 12 in the conventional manner. This facilitates both fabrication of the outer frame 14 and finishing the outer frame 14 and the vessel 12.

It is not essential in all cases that the lower and upper frame portions 126, 128 be fabricated together as described above. If desired, the two frame portions 126, 128 may be fabricated separately, and then joined together to form the outer frame 14. However, the preferred method as described above provides the advantage that each of the end frames 40 can be precisely shaped and sized with only a single set of welding fixtures.

Table I provides a list of specifications for a presently preferred embodiment of the container 10. This embodiment has a height of 114 inches, a width of 96 inches, and an overall length of 480 inches. Table II provides a list of preferred materials that can be used in construction of the container 10. Of course, it should be clearly understood that all the information in Tables I and II is provided only by way of example to define the presently preferred embodiment of this invention. All of these details can readily be modified or changed entirely, as appropriate for the particular application.

From the foregoing it should be apparent that an improved intermodal bulk container has been described. This container combines the advantages of a durable, readily repaired, steel outer frame in combination with an aluminum vessel that uses thin aluminum for the shell and hopper sheets (less than ¼ inch in thickness), and is therefore light in weight and low in cost.

Of course, it should be understood that a wide range of changes and modifications can be made to the preferred embodiment described above. For example, materials, dimensions, and proportions can all be varied as appropriate for the particular application. It is intended that the foregoing detailed description be regarded only as an illustration of one form that the invention can take, and not as a limitation of the invention. It is only the following claims, including all equivalents, that are intended to define the scope of this invention.

TABLE I

| | |
|---|---|
| Materials: | 5454 H32, 6061-T6 aluminum as dictated by design. ISO 1161 corner castings. 350A or 350W hollow structural steel frame. |
| Capacity: | 1650 cu. ft. volume capacity. 67,200 lbs. (30,482 kgs) mass capacity. 14.5 psig operating pressure rating. |
| Manways: | Knappco LM1120 20" full opening holddown type manways. |
| Discharge Outlets: | Aerated discharge complete with 4" outlets. |
| Piping: | 3" aluminum (SCH 10) air line. 4" aluminum (SCH 40) product discharge line. |
| Valves: | Ultra Flow Model 400 butterfly valves. 3" air control valves, 4" product valves, 2" aerator valves. Bayco 14.9 psi aluminum body tank relief, Bayco 18.1 psi aluminum body line relief, 3" dial air pressure gauges. |

TABLE I-continued

| | |
|---|---|
| Inlets/Outlets: | 3" male adaptors and dust caps. 4" male adaptors and dust caps. |
| Gaskets: | White rubber/food grade. |
| Fill Lines: | 1 of 5" inlet stinger at each end of tank on the right hand side. 1 of 6" inlet stinger on rear end of tank on the left hand side. All connections male adaptor. Dust caps included on outside. |
| Hydrostatic Test: | 1.5 times operating pressure. |
| Internal Weld Finish: | NTTC recommended practice W-2. Smoke and heat discoloration removed from the parent metal adjacent to the weld on the interior of the vessel and weld finished to assure sharp peaks and craters are not present. The weld surface shall not snag cheesecloth rubbed over its surface. Discoloration may remain in recessed areas of the weld bead itself or on the edge of the metal adjacent to the weld bead. |
| External Finish: | DuraLac or similar corrosion barrier installed at aluminum to steel interfaces. Aluminum components natural finish. Steel components sandblasted, primed with zinc-chromate, finish coated Endura paint materials. |
| Walkway: | 18" aluminum ISG walkway full length right hand side. Ladder rear end right hand side. |
| Tare Weight: | 10,000 lbs. ± 1%. |

TabIe II

| Ref. No. | Description | Preferred Material (S = 350A/350W steel) (A1 = 5454-H32 Al Alloy) (A2 = 5454 O-Temper) (A3 = 6061-T6) (inches) | Preferred Dimensions |
|---|---|---|---|
| 16,26,30 | shell, hopper, pad | A1 | .188 Th |
| 24 | end | A2 | .25 Th |
| 32 | partition wall | A1 | .25 Th |
| 28 | cross brace | A3 | 3" Sched.40 |
| 42 | column | S | 6 × 6 × 3/16 |
| 44 | beam | S | 4 × 4 × 3/16 |
| 48 | corner casting | | ISO 1161 |
| 54,56, 64,66,46 | chord, brace | S | 3 × 3 × 3/16 |
| 58,68 | cross brace | S | 2 × 3 × ⅛ |
| 63 | corner plate | S | 20 × 12 × 3/16 |
| 70,72 | cross tube | S | 3 × 3 × 3/16 |
| 80 | lower support plate | A3 | 88 × 19 × 3 × ⅜ |
| 82 | plate angle | A3 | 2¼ × 3 × ⅜ (6" long) |
| 84 | lower end plate | A1 | 11⅞ × 3⅜ × ¼ |
| 86 | pad | A1 | 44 × 2¾ × ¼ |
| 88 | pad | A1 | 6 × 3 × ⅜ |
| 90,100 | sill angle | S | 2¼ × 2½ × ¼ (6" long) |
| 98 | upper end plate | A1 | 14⅛ × 5⅛ × ⅜ |
| 102 | upper plate angle | A1 | 6 × 5⅛ × ½ |

We claim:

1. An intermodal bulk container comprising:

an outer frame comprising:

first and second spaced end frames;

first and second upper trusses interconnecting the end frames;

first and second lower trusses interconnecting the end frames, each said lower truss comprising a sill;

a container vessel mounted within the outer frame, said vessel comprising:

a cylindrical shell forming a plurality of lower openings;

a plurality of hoppers mounted in the shell and extending out of the lower openings, said hoppers joined to an interior surface of the shell above the openings;

first and second domed end portions secured to the shell to close respective ends of the shell; and a plurality of lower support plates secured to an exterior surface of the shell, each said lower support plate secured to a respective one of the sills to securely mount the vessel within the frame, such that the upper trusses are situated on respective sides of the vessel and the lower trusses are situated on respective sides of the vessel.

2. The invention of claim 1 further comprising a plurality of upper support plates secured to the exterior surface of the shell, each said upper support plate secured to a respective one of the upper trusses.

3. The invention of claim 2 wherein the lower support plates extend parallel to the lower trusses, and wherein the upper support plates extend parallel to the end frames.

4. The invention of claim 1 wherein all points of contact between the outer frame and the vessel are spaced from the end frames by at least eight inches.

5. The invention of claim 1 wherein two of the lower support plates are fixedly secured to the respective sills, and wherein the remaining support plates are slideably secured to the respective sills.

6. The invention of claim 1 wherein the shell comprises sheet aluminum having a thickness less than ¼ inch.

7. The invention of claim 1, wherein each lower support plate comprises a support plate angle, wherein each sill comprises a sill angle aligned with each support plate angle, and wherein the respective support plate angles and sill angles are secured together by threaded fasteners.

8. An intermodal container comprising:

an outer frame comprising:

first and second spaced end frames;

first and second upper trusses interconnecting the end frames;

first and second lower trusses interconnecting the end frames, each said lower truss comprising a sill;

a container vessel mounted within the outer frame, said container vessel comprising:

a cylindrical shell forming a plurality of lower openings;

a plurality of hoppers mounted in the shell and extending out of the lower openings, said hoppers joined to an interior surface of the shell above the openings;

first and second domed end portions secured to the shell to close respective ends of the shell; and a plurality of lower support plates secured to an exterior surface of the vessel, each said lower support plate clamped to a respective one of the sills by removable fasteners such that the lower support plates rest on the sills to support the vessel in the outer frame, and at least some of the lower support plates are slideable along the respective sills.

9. The invention of claim 8 wherein the outer frame comprises separable upper and lower frame portions.

10. The invention of claim 8 further comprising a plurality of upper support plates secured to the exterior surface of the vessel, each said upper support plate secured to a respective one of the upper trusses.

11. The invention of claim 10 wherein the lower support plates extend parallel to the lower trusses, and wherein the upper support plates extend parallel to the end frames.

12. The invention of claim 8 wherein all points of contact between the outer frame and the vessel are spaced from the end frames by at least eight inches.

13. The invention of claim 8 wherein two of the lower support plates are fixedly secured to the respective sills, and wherein the remaining support plates are slideably secured to the respective sills.

14. The invention of claim 8 wherein the vessel comprises sheet aluminum having a thickness less than ¼ inch.

15. The invention of claim 8, wherein each lower support plate comprises a support plate angle, wherein each sill comprises a sill angle aligned with each support plate angle, and wherein the respective support plate angles and sill angles are secured together by threaded fasteners.

* * * * *